US012169113B2

(12) United States Patent
Smith et al.

(10) Patent No.: US 12,169,113 B2
(45) Date of Patent: Dec. 17, 2024

(54) SELECTABLE AIRSOFT HANDGUN ACTUATING MECHANISM AND RELATED METHODS

(71) Applicant: La Capa Customs, LLC, Shreveport, LA (US)

(72) Inventors: Ivan Sutton Smith, Shreveport, LA (US); Margarito Guzman, Bakersfield, CA (US)

( * ) Notice: Subject to any disclaimer, the term of this patent is extended or adjusted under 35 U.S.C. 154(b) by 0 days.

(21) Appl. No.: 18/115,313

(22) Filed: Feb. 28, 2023

(65) Prior Publication Data

US 2024/0288245 A1 Aug. 29, 2024

(51) Int. Cl.
*F41B 11/70* (2013.01)
*F41A 19/16* (2006.01)

(52) U.S. Cl.
CPC ..... *F41B 11/70* (2013.01); *F41A 19/16* (2013.01)

(58) Field of Classification Search
CPC ..... F41B 11/70; F41A 11/60
See application file for complete search history.

(56) References Cited

U.S. PATENT DOCUMENTS

| | | | |
|---|---|---|---|
| 2,462,505 | A | 2/1949 | Kennedy |
| 5,476,087 | A | 12/1995 | Kunimoto |
| 5,760,328 | A | 6/1998 | Robbins |
| 6,026,797 | A | 2/2000 | Maeda et al. |
| 6,412,206 | B1 | 7/2002 | Strayer |
| 6,729,322 | B2 | 5/2004 | Schavone |
| 7,273,047 | B2 | 9/2007 | Hu |
| 7,353,816 | B2 | 4/2008 | Maeda et al. |
| 7,819,051 | B1 | 10/2010 | Beckmann et al. |
| 8,087,343 | B2 | 1/2012 | Landies et al. |
| 8,127,481 | B2 | 3/2012 | Rozum et al. |
| 8,522,761 | B1 | 9/2013 | Chu |
| 8,881,443 | B2 | 11/2014 | Westwood et al. |
| 8,931,468 | B2 * | 1/2015 | Huang ..... F41A 19/59 124/72 |
| 9,151,565 | B2 | 10/2015 | Peterson |
| 9,291,420 | B1 | 3/2016 | Jensen et al. |
| 9,733,034 | B1 | 8/2017 | Viani |
| 9,952,016 | B2 | 4/2018 | Sullivan |

(Continued)

FOREIGN PATENT DOCUMENTS

| | | |
|---|---|---|
| EP | 3163246 | 5/2017 |
| EP | 3708943 | 9/2020 |

(Continued)

OTHER PUBLICATIONS

Evike. Dual Stainless, Manual. Evike. CA, USA.

(Continued)

*Primary Examiner* — Reginald S Tillman, Jr.
(74) *Attorney, Agent, or Firm* — Sierra IP Law, PC; William K. Nelson

(57) ABSTRACT

A selector assembly incorporated into the frame of an airsoft handgun that is operable to configure the airsoft gun in a semi-automatic or full-automatic firing mode. The selector assembly is operable to adjust the position of a disconnector and a sear such that the engagement surfaces of the disconnector and sear are configured to interact with the hammer and firing assembly such that one or multiple rounds are propelled down the barrel for each trigger engagement.

20 Claims, 12 Drawing Sheets

(56) References Cited

U.S. PATENT DOCUMENTS

| | | | |
|---|---|---|---|
| 10,436,533 | B2 | 10/2019 | Ferguson |
| 10,712,112 | B2 | 7/2020 | Maeda |
| 11,168,952 | B2 | 11/2021 | Palkow |
| 2007/0181116 | A1 | 8/2007 | Wei |
| 2018/0252494 | A1 | 9/2018 | Masse |
| 2019/0285373 | A1 | 9/2019 | Palkow |
| 2022/0099397 | A1 | 3/2022 | Watkins |

FOREIGN PATENT DOCUMENTS

| | | |
|---|---|---|
| JP | 2006292266 | 10/2006 |
| JP | WO2008114461 | 9/2008 |
| JP | 5164892 | 12/2012 |
| WO | 2008075999 | 6/2008 |

OTHER PUBLICATIONS

Kjworks. HI-CAPA Manual. Manual. Kjworks. Taoyuan, Taiwan.
Marui. Hi-Kick Hi-Grouping Hi-Capa 5.1 Government Model. Tokyo Marui. Japan.
Marui. Gas Gun Empire. Tokyo Marui. Japan.
PCT International Search Report and Written Opinion of the International Searching Authority, dated May 28, 2024.

* cited by examiner

SELECTABLE AIRSOFT HANDGUN ACTUATING MECHANISM AND RELATED METHODS

FIELD OF THE INVENTION

The present invention relates generally to a gun (e.g., airsoft gun) and actuating mechanisms for selecting the fire rate of a projectile and methods of using the same. More particularly, the present invention provides a trigger assembly that is operable to configure and switch the gun between a semi-automatic firing configuration and a full-automatic firing configuration.

BACKGROUND OF THE INVENTION

An airsoft gun is a non-lethal replica firearm that fires small plastic projectiles known as BBs. These guns are often used for recreational activities such as simulated military or law enforcement training and target shooting. They are typically made with metal or plastic bodies and use a spring-loaded mechanism, electric motor, or compressed gas canister to propel the BBs. Airsoft guns are designed to be as realistic as possible, often resembling real firearms in appearance. High-capacity airsoft guns utilize a spring-loaded magazine to store and feed BBs into the gun. When the trigger is pulled, a spring-loaded valve knocker (e.g., piston) is released and propels a BB out of the barrel through the muzzle. The magazine can hold a large number of BBs, allowing the gun to fire many shots without manual reloading. Some airsoft guns also can fire in fully automatic mode, where the gun continuously fires BBs as long as the trigger is held down or until the magazine is empty. The trigger operates a sear, which is a latch that holds the spring-loaded piston in place when the gun is cocked. When the trigger is pulled, the sear is released, the hammer rotates forward and the valve knocker moves forward, firing a BB.

Various firearm platforms are replicated in airsoft guns, and one of the most popular platforms is the 1911A1 firearm and the 2011 which is a variant of the 1911 that is double stacked and provides a wider grip. A 1911 air soft gun includes similar components to the traditional firearm, such as a frame, slide, barrel, and a firing assembly that includes a disconnector, sear, hammer, disconnect pins, and various springs. Unlike traditional firearms, where a firing pin strikes a cartridge to combust gunpower and propel the projectile down the barrel and retract the slide, an airsoft gun utilizes a spring-loaded piston and compressed air to propel the BB down the barrel and includes additional components, such as a blowback unit positioned in the slide and frame to simulate the combustion of a cartridge and the sliding action of a traditional firearm. In comparison, traditional firearms have selectable firing configurations, including semi-automatic, fully automatic, burst fire, and safety. Mechanically actuated airsoft handguns that use compressed gas and spring-actuated airsoft handguns are limited to a safety mode and either a semi-automatic or a full-automatic firing mode. There is a need for an airsoft handgun system (e.g., Hi-Capa, 2011, 1911, etc.) that is configurable between a semi-automatic and a full-automatic firing mode.

SUMMARY OF THE INVENTION

The present invention provides a trigger mechanism that is operable to switch the fire rate configuration of a toy gun (e.g., airsoft handgun, 2011, etc.) between semi-automatic and fully automatic firing rate to provide a realistic simulation of a real firearm.

Accordingly, the present invention provides a gun (e.g., an air gun) having a frame (e.g., lower receiver) that is operable to secure a grip, a safety, a trigger assembly, a slide (e.g., upper receiver), and a magazine. The trigger assembly may include a disconnector, a sear, a sear spring, a hammer, a hammer strut, a safety, a grip safety, side panel, a chassis cover plate, a valve knocker, a valve knocker torsion spring, a knocker lock, a knocker lock spring, a hammer pin, a trigger, and a trigger bar. The trigger assembly may secure to the inside of the frame body with various screws and mounting points. In some embodiments, the trigger assembly may include a selector switch pin, a selector switch spring, and a selector cover plate. The slide may include a blowback unit, frame, barrel, a hop-up unit, and may be in communication with the frame and have a recoil spring that is operable to return the slide to the starting position after discharging a round.

In assembly, the trigger and trigger bar are fixedly mounted together and may be positioned through the grip and in communication with the disconnector. The sear is mounted on a shaft that positions a lower pawl of the sear in contact with the disconnector. A sear spring applies constant forward pressure to the disconnector and sear and is operable to impart a forward rotation to the sear when the sear is disengaged from the disconnector. The sear may have an upper pawl (e.g., locking pawl) that is normally engaged with a hammer to prevent rotation. The hammer communicates with a valve knocker that is actuated forward and releases gas from a magazine. The gas travels up through a nozzle in the blowback unit and propels the BB through the hop up unit and down the barrel. The compressed gas pushes the nozzle, the blowback unit, and the slide in a backwards direction mimicking a recoil and resets the hammer, the disconnector, the valve knocker, and firing pin positions. A spring in the front of the gun then returns the slide forward to its initial position. The BB may sit in an opening of the hop up unit before the trigger is pulled and once fired it is replaced in the hop up unit by the forward returning of the nozzle in the blowback unit.

The present invention provides a disconnector and sear combination that are operable to switch the airsoft gun firing configuration between a semi-automatic firing rate and a fully automatic firing rate. The disconnector may include a selector pin, a rear indent, an engagement pin, a wedge post, and a trigger bar interface that is operable to translate a trigger actuation to the firing components. The sear may have an upper locking pawl, a lower pawl, and a lower cutout. The frame may have a selector slot that is operable to secure the disconnector selector pin and may have a structure operable to receive the selector switch assembly.

The present invention provides a semi-automatic configuration that configures the disconnector and sear in a position that allows only one round to be discharged down the barrel when the trigger is squeezed and requires an operator to disengage the trigger to reset the system. In such configurations, the disconnector selector pin may be positioned at the top of the selector slot and the sear engages with the wedge post of the disconnector. When discharging a round, the trigger and trigger bar is pulled backward, pushing the disconnector horizontally backward and rotating the sear out of the teeth of the hammer, releasing the hammer to rotate forward and discharge the round. During the discharging process, the slide and blowback unit recoil backward and a ramp on the blowback unit pushes the disconnector downwards, disconnecting it from the sear before the slide and blowback unit return to position. The lower cut out of the sear may engage with the disconnector engagement post, and the sear rotates to a hammer locking position. After a round is done cycling, if the trigger remains depressed, the disconnector stays down and disconnected from the sear, and the sear rotates back to position to engage with the teeth. When the trigger is released forward, the disconnector may move up between the trigger bar and the sear.

The present invention provides a fully automatic firing configuration in which the sear and disconnector are disengaged from the firing component when the trigger is engaged. In such embodiments, the disconnector switch is pulled down, and the selector pin engages with the disconnector indent preventing upward and downward movement and locking the disconnector below the frame rails, not allowing the blowback unit to engage with the disconnector during recoil. The disconnector engagement post interfaces with the lower pawl of the sear. When discharging a round, the trigger and trigger bar are pulled backward, pushing the disconnector horizontally backward and rotating the sear out of the teeth of the hammer, releasing the hammer to rotate forward and discharge the round. While the trigger remains squeezed, the disconnector and the sear maintain their position, providing no interference with the hammer. The hammer continuously rotates forward and backward, discharging rounds because of the spring and recoil forces. Once the trigger is released forward, the disconnector and sear move back to their original position, and the sear engages with the hammer teeth preventing discharging.

It is an aspect of the present invention to provide a mechanism for selecting a fire rate of an airsoft gun actuating system, the device may include: a sear having a stop pawl on the top end, a lower cutout, and a lower engagement surface at the base of the lower cutout; a disconnector having a body, an angled tip on a top end, a selector post on a first side, an engagement post and a wedge post on a second side, a trigger bar interface on a front surface, and a locking indent on a rear surface; and a frame having a channel operable to receive the disconnector body and a slot operable to receive the selector post and to secure a trigger, a slide, a hammer and rotatably secure the sear, wherein the disconnector is operable to configure the sear in a semi-automatic and fully-automatic firing position. The disconnector may be in communication with the trigger at the trigger bar interface and may be operable to translate with the trigger and rotate around the selector post when the trigger is engaged. The sear lower pawl engages with the disconnector wedge post in semi-automatic configurations and may be operable to disengage the locking pawl from the teeth of the hammer when the trigger is engaged. While the trigger is engaged, a round is discharged, and a slide may translate to a rear position, and a disconnector angled tip may engage with a blowback unit disconnector ramp and translate downward, thereby disengaging the sear lower pawl from the disconnector wedge post, and the sear lower cutout engages with the disconnector engagement post. The lower cutout may engage with the disconnector engagement post, thereby positioning the sear locking pawl with the hammer teeth and locking the hammer.

It is a further aspect of the present invention to provide a frame with a selector switch assembly that may include a selector pin positioned between the frame and disconnector that may be operable to engage with the disconnector locking indent and lock the disconnector below the frame, a spring between a selector pin and a frame slot that may be operable to translate the selector pin forward; and a cover that is operable to hide and secure the selector pin and spring to the frame. The disconnector selector post may be positioned at the bottom of the frame slot, and the selector pin engages with the disconnector locking indent to configure the disconnector in a fully automatic firing configuration. The fully automatic firing configuration positions the disconnector angled tip below the top of the frame and the lower pawl of the sear in engagement with the engagement post. The disconnector may be in communication with the trigger on the trigger bar interface and is operable to translate with the trigger and rotate around the selector post when the trigger is engaged, and the sear is operable to rotate around a sear pin and disengage the locking pawl from the hammer teeth when the trigger is depressed, and a round is discharged. The sear may engage with the disconnector engagement post while the trigger remains depressed, and the locking pawl maintains disengagement from the hammer teeth, allowing for continuous rotation of the hammer and discharging of successive rounds.

It is another aspect of the present invention to provide a semi-automatic and fully automatic firing switch for an airsoft gun actuating system, that may include: a frame being operable to secure a trigger mechanism, a slide, a barrel, a safety switch, and providing a slot for controlling the trigger mechanism with a selector switch, where the trigger mechanism may include: a trigger and a trigger bar in communication with a disconnector having a selector post that extends through the frame slot and may be operable to configure the disconnector in a locked automatic position and a semi-automatic position; and a sear in communication with the disconnector and under a spring tension that is operable to actuate a hammer and regulate a rate of fire; wherein the trigger mechanism disconnector is in communication the selector switch and may be operable to position the disconnector above the frame for semi-automatic fire and below the frame for fully automatic fire. The trigger mechanism may be in a semi-automatic position and the sear may include a lower pawl that engages with a disconnector wedge post. When the trigger is engaged, the disconnector translates with the trigger bar, the lower pawl maintains engagement with the disconnector wedge post, a sear locking pawl disengages from the hammer, and a round is propelled through the barrel, and the slide translates backward. The slide may translate backward, resetting the hammer and translating the disconnector down, thereby disengaging the lower pawl of the sear from the disconnector wedge post and positioning a lower cutout of the sear in collision with a disconnector engagement post, thereby rotating the sear and locking pawl in a position to lock the hammer. The locked hammer is maintained while the trigger is engaged, and the sear and disconnector are in communication with a sear spring that is operable to position the sear and disconnector to a starting position when the trigger is released. When the trigger assembly is in a fully automatic configuration, the user may slide the selector post to the bottom of the frame slot, thereby dropping the disconnector to a lower position and positioning a lower pawl of the sear in contact with a disconnector engagement post. When the trigger is subsequently engaged, the disconnector and sear are translated, and a locking pawl of the sear disengages from the trigger allowing a round to propel down the barrel and the slide translates backward, thereby resetting the hammer and the locking pawl and disconnector, maintaining the translated position, and allowing for continuous actuation of the hammer and slide while the trigger is engaged. When the trigger is disengaged, the disconnector and sear translate to the starting position, and the locking pawl of the sear is engaged with the hammer, thereby interfering with the hammer rotation.

It is another aspect of the present invention to provide a method for selectively switching an airsoft gun actuating mechanism between a semi-automatic and a fully automatic configurations, the method may include use of an airsoft gun having a frame provided with a disconnector, a sear, a trigger, a hammer, a selector switch, and a slide housing a barrel and a blowback unit; and a spring-loaded selector lock positioned in the frame that is operable to lock the disconnector below the frame; the disconnector may be in constant engagement with the sear and may be under a spring tension, and when the trigger is squeezed the disconnector swivels about a frame mounting point and the sear is disengaged from the hammer thereby rotating the hammer and discharging a round through the barrel. Subsequently, the slide may translate backward to reset the hammer. The disconnector may include a selector pin that is positioned in a frame slot and that allows a user to select a fully automatic configuration, which results in positioning the disconnector below the frame and the selector pin being positioned at a base of the frame slot and the semi-automatic position configures the disconnector and selector pin at the top of the frame slot.

Further aspects and embodiments will be apparent to those having skill in the art from the description and disclosure provided herein.

It is an object of the present invention to provide a 1911, Hi-Capa, and 2011 airsoft handgun platforms with a selector switch assembly allowing the user to switch the gun between semi-automatic and fully automatic firing configuration.

It is an object of the present invention to provide a replacement disconnector and sear for an airsoft handgun system to enable a user with the ability to select the fire rate of the projectile between semi-auto and full-auto fire rates.

The above-described objects, advantages, and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

Figure 1:
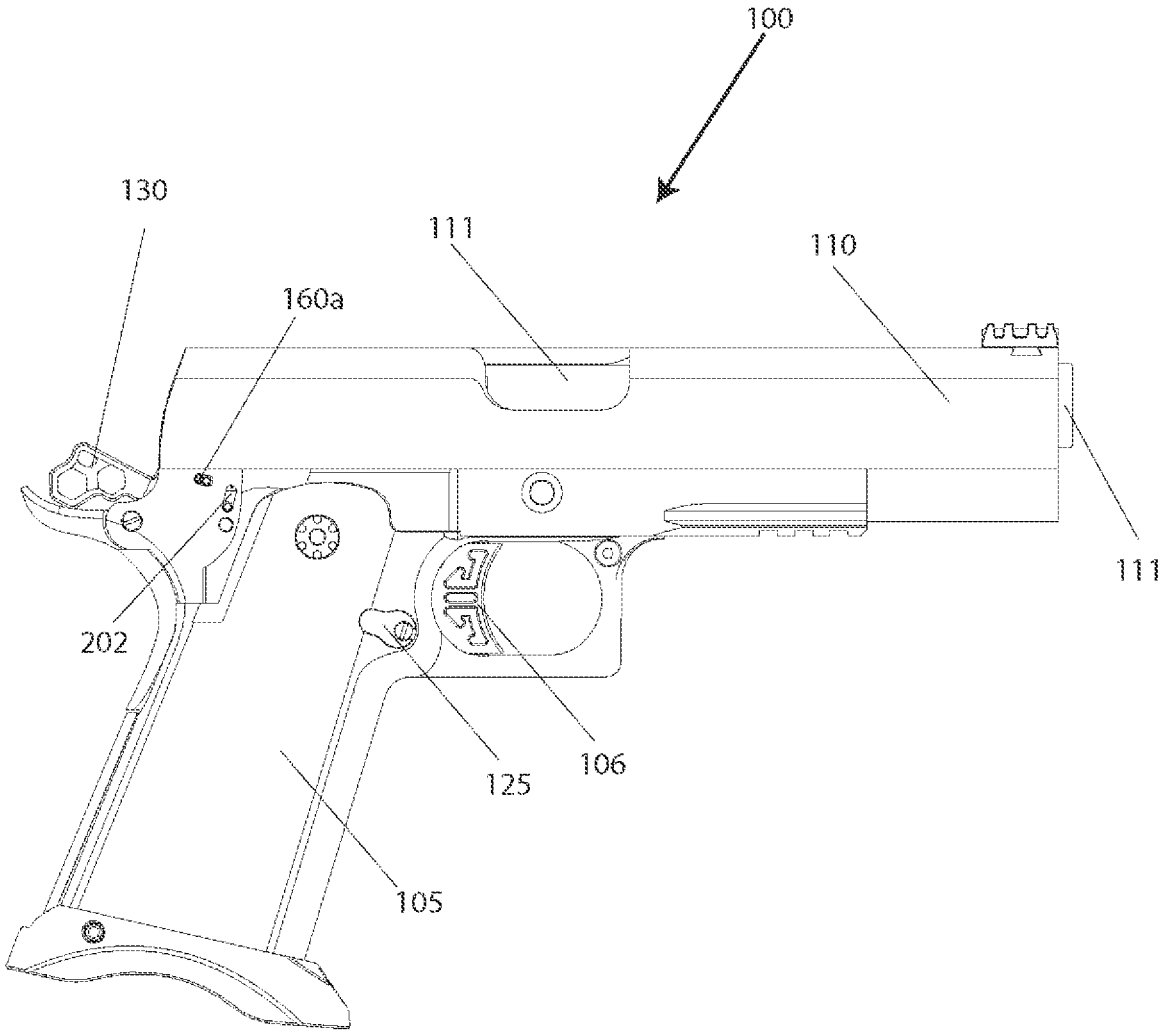
FIG. 1 provides a side view of an airsoft handgun, according to an embodiment of the present invention.
Figure 2:
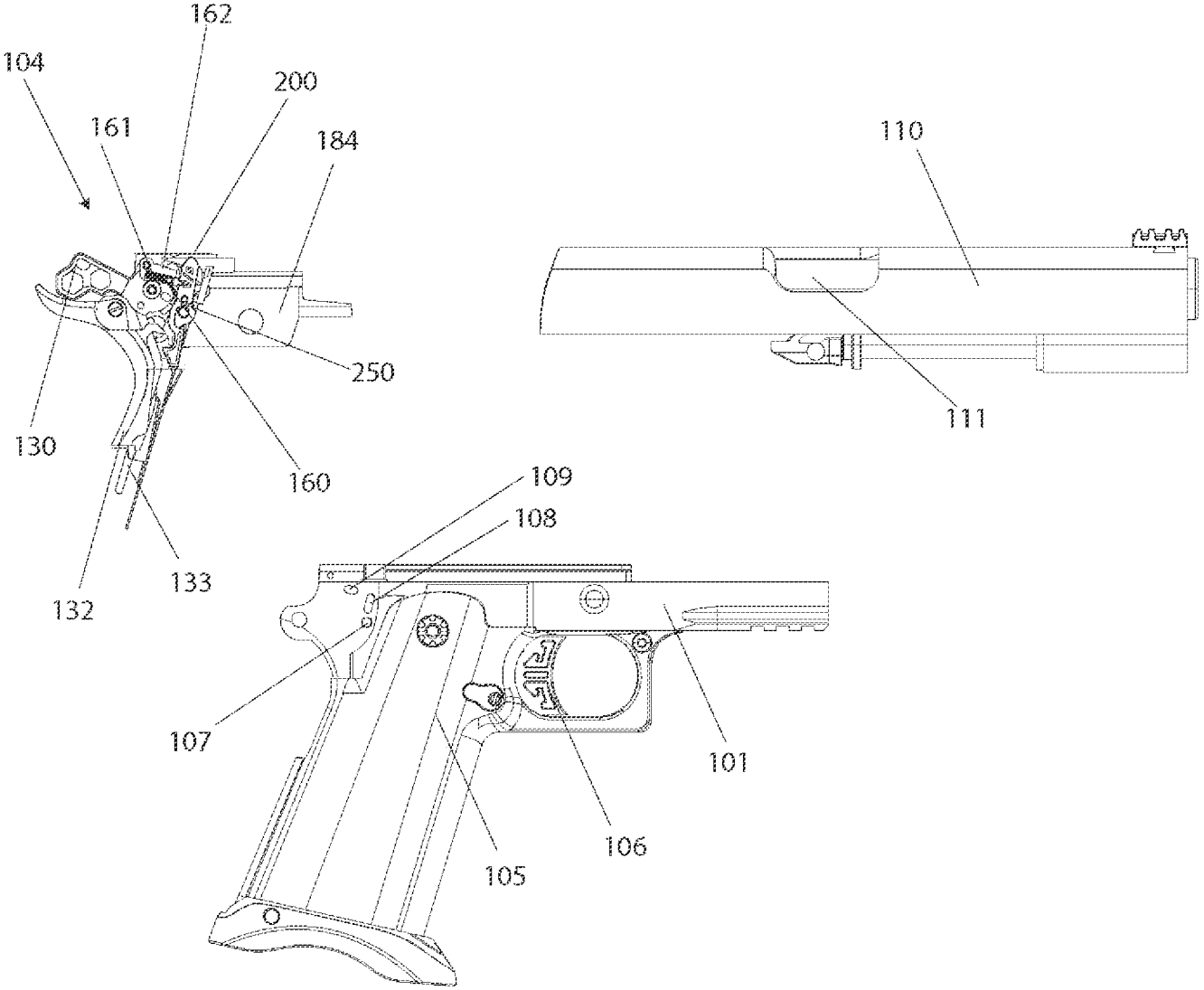
FIG. 2 provides an exploded side view of an airsoft handgun, according to an embodiment of the present invention.

The present invention concerns an air pistol fire selector system incorporated into a handgun air pistol. FIGS. 1-13D provides views of an exemplary air pistol 100 incorporating the firing assembly 104 according to the present invention. The exemplary air pistol 100 includes a frame 101 (e.g., lower receiver) that is operable to receive a slide 110 and a firing assembly 104, as illustrated in the exploded side view of FIG. 2. The frame 101 may include a grip 105, a sear pin conduit 107, a selector pin slot 108, a magazine release 125, and a locker slot 109. The frame 101 may also secure a trigger 106 that is in communication with a trigger bar 126 and a slide stop 135 that interacts with the slide 110. The slide 110 may include a barrel 111, a blowback unit 114, a hop-up unit 115 that is operable to impart rotation to a projectile when traveling down the barrel 111.

Figure 3:
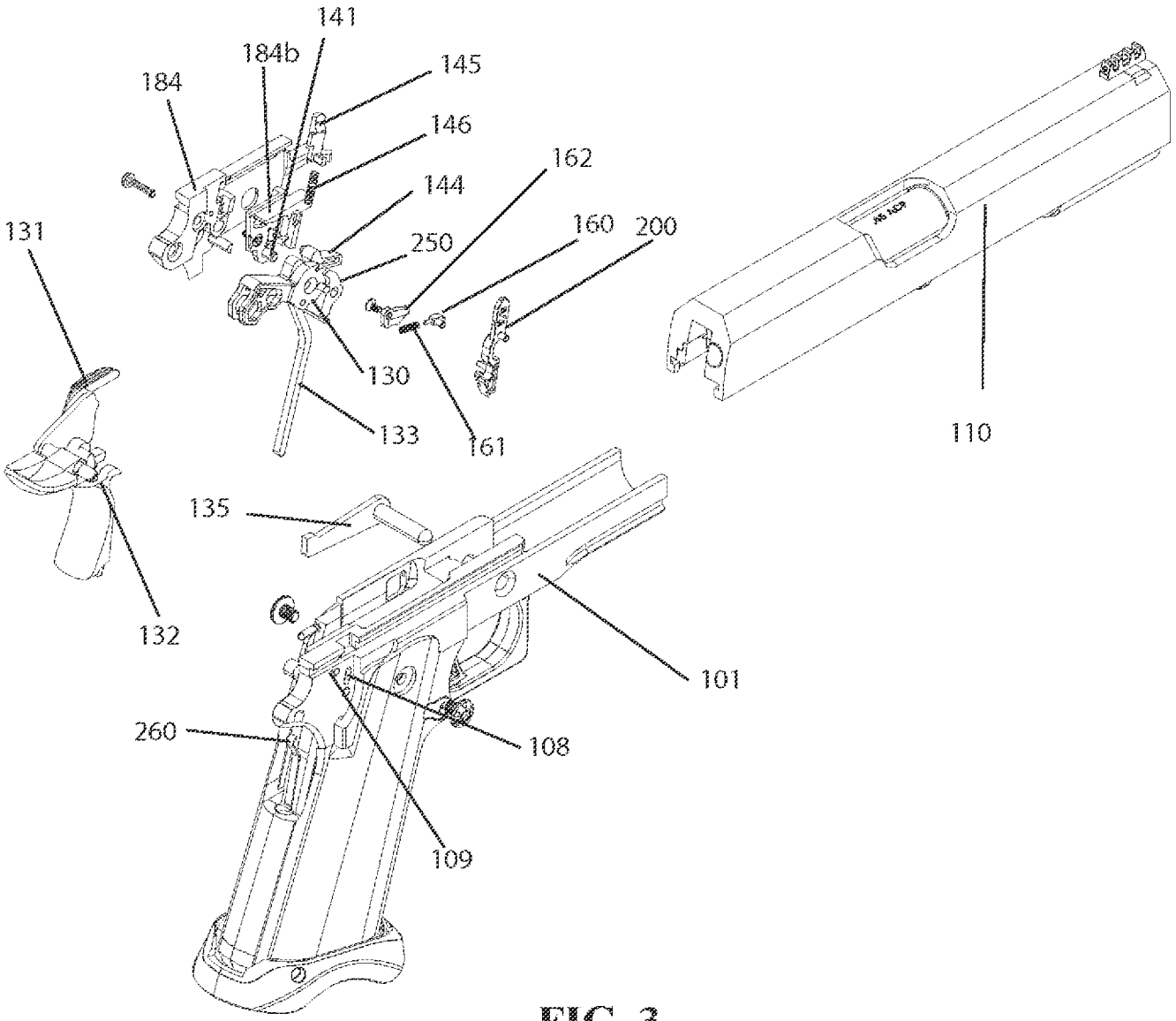
FIG. 3 provides a perspective view of an exploded airsoft handgun, according to an embodiment of the present invention.
Figure 4A:
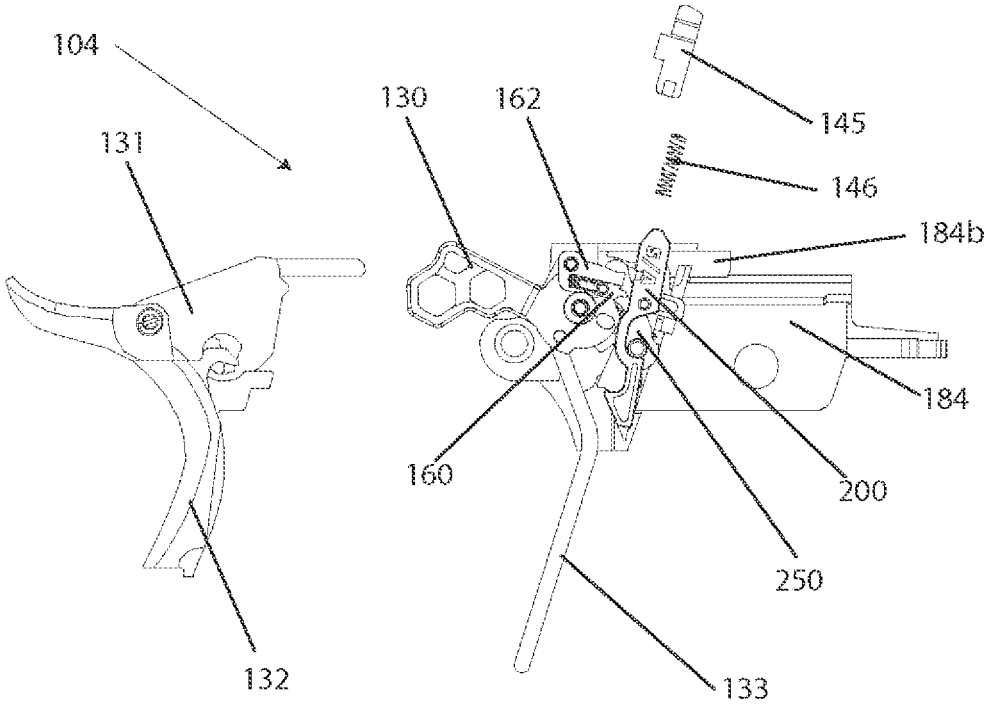
FIG. 4A provides an exploded side view of an airsoft handgun firing assembly, according to an embodiment of the present invention.
Figure 4B:
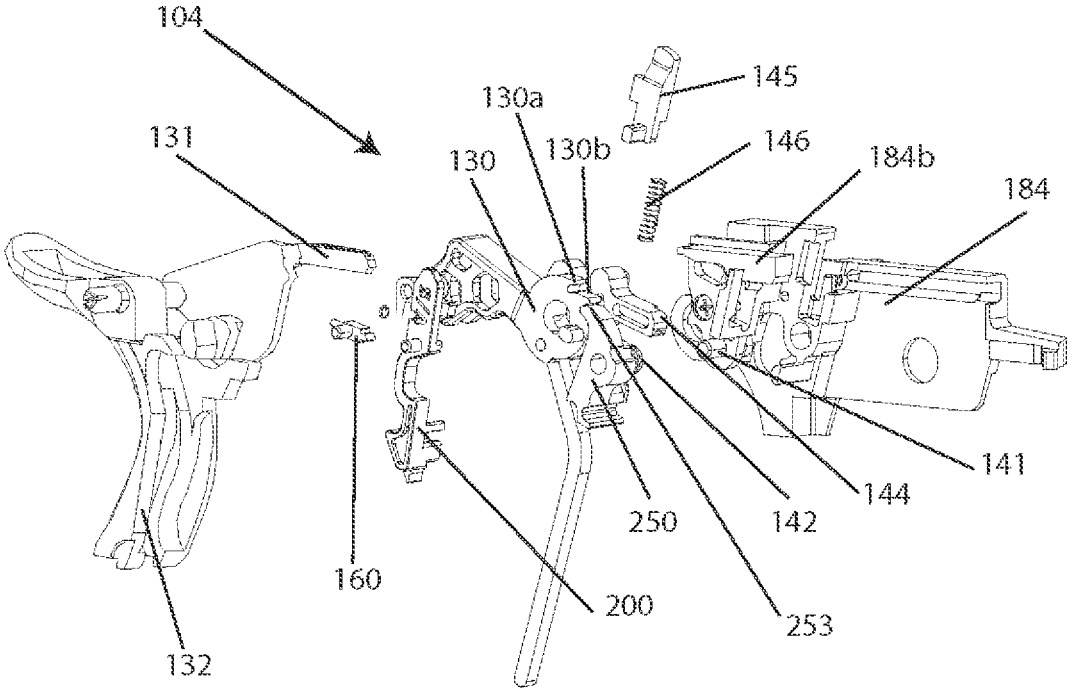
FIG. 4B provides a perspective view of an exploded airsoft handgun firing assembly, according to an embodiment of the present invention.
Figure 5A:
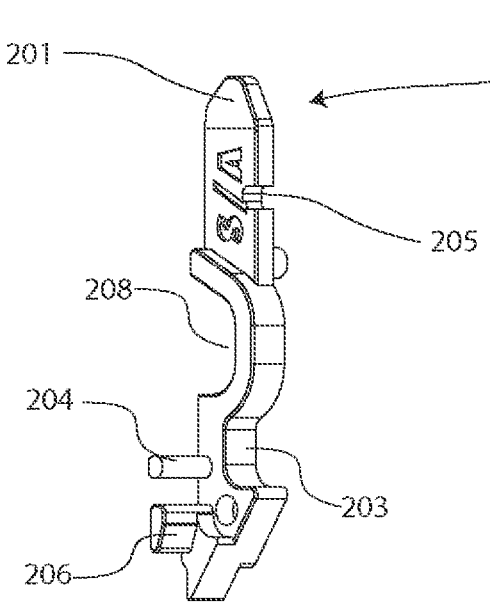
FIG. 5A provides a perspective view of a disconnector component of an airsoft handgun, according to an embodiment of the present invention.
Figure 5B:
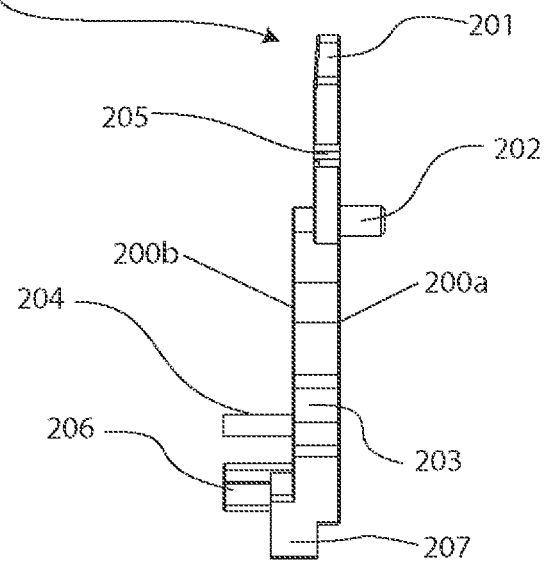
FIG. 5B provides a rear view of a disconnector component of an airsoft handgun, according to an embodiment of the present invention.
Figure 5C:
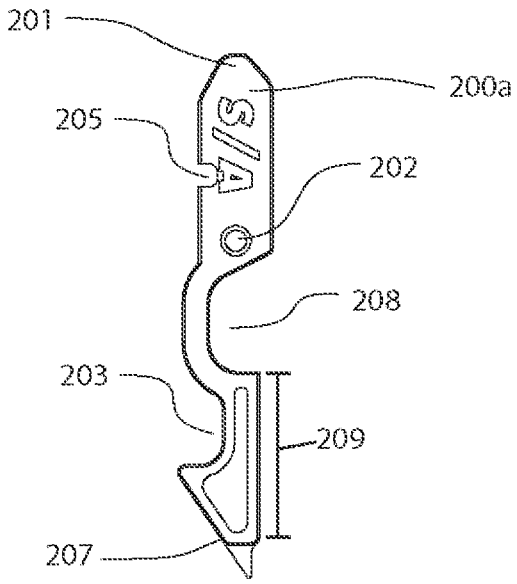
FIG. 5C provides a first side view of a disconnector component of an airsoft handgun, according to an embodiment of the present invention.
Figure 5D:
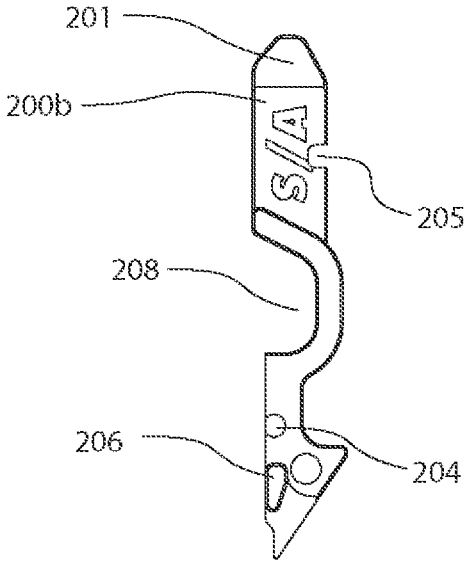
FIG. 5D provides a second side view of a disconnector component of an airsoft handgun, according to an embodiment of the present invention.
Figure 6A:
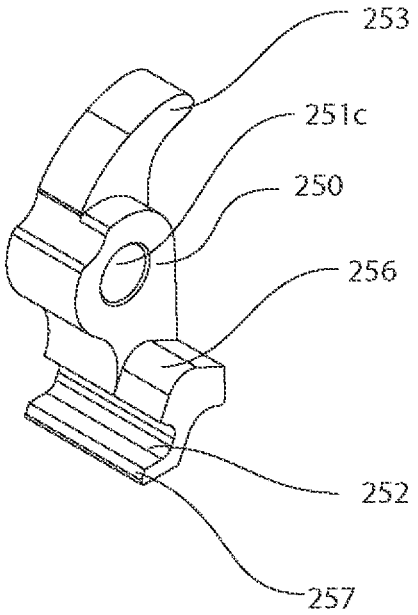
FIG. 6A provides a perspective view of a sear component of an airsoft handgun, according to an embodiment of the present invention.
Figure 6B:
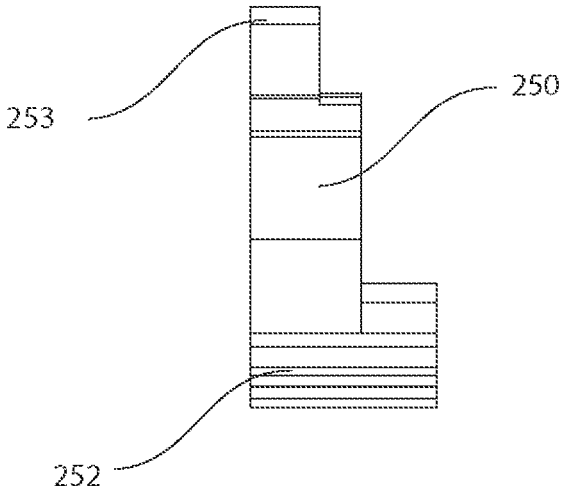
FIG. 6B provides a front view of a sear component of an airsoft handgun, according to an embodiment of the present invention.
Figure 6C:
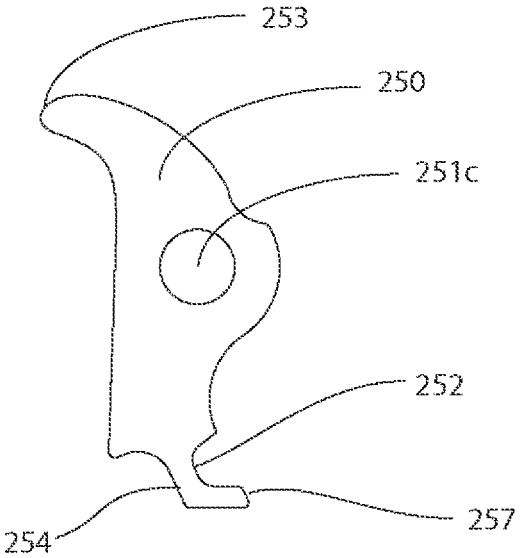
FIG. 6C provides a first side view of a sear component of an airsoft handgun, according to an embodiment of the present invention.
Figure 6D:
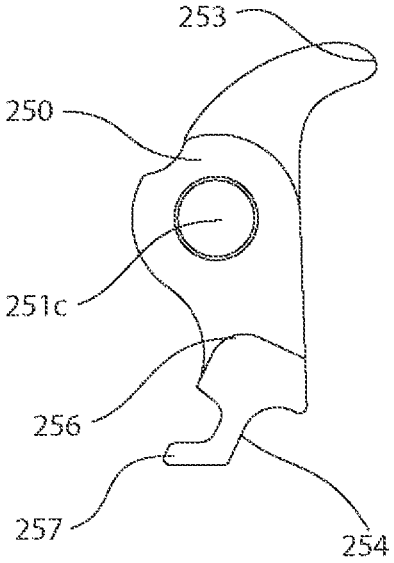
FIG. 6D provides a second side view of a sear component of an airsoft handgun, according to an embodiment of the present invention.

The firing assembly 104 as shown in the exploded view of FIG. 3 may include a disconnector 200, a sear 250, a thumb safety 131, a hammer 130, a hammer strut 133, a grip safety 132, a sear pin 251, a side panel 184, a chassis cover 184*b*, a valve knocker 144, a firing pin 145, a firing pin spring 146, and a knocker spring 142. When assembled, the disconnector 200 and sear 250 may communicate with a sear spring 260 that is positioned against the grip safety 132 and secured to the frame 101 with a sear pin 251. The chassis cover 184*b* includes a post 141 operable to position the knocker spring 142. The knocker spring 142 is operable to provide a tension force on the valve knocker 144.

In some embodiments, as shown in FIGS. 5A-5D, the disconnector 200 may have various cutouts and posts that facilitate switching the airsoft gun 100 from a semi-auto to full-auto configuration. The disconnector 200 may have a first side 200*a* (e.g., right side), a second side 200*b* (e.g., left side), the first side 200*a* may be positioned adjacent to the interior of the frame when assembled, and the second side 200*b* may be positioned against the sear 250. The disconnector 200 may include an angled tip 201 positioned at the top that is operable to interfere with a blowback unit frame 114, an indent 205 positioned between the first and second sides 200*a*, 200*b*, a selector post 202 positioned on the first side 200*a*, and a second post 204 and wedge post 206 positioned on the second side 200*b*. The disconnector 200 may include a front channel 208 and a rear channel 203 that are operable to provide space for a sear pin 251 and other components. The selector post 202 may extend through the selector pin slot 108 to allow operator access. The disconnector 200 may have a substantially flat lower front surface 209 that is operable to receive inputs from a trigger bar 126 when the trigger 106 is engaged. The disconnector may have a sear spring surface 207 that is under constant force from the sear spring 260.

In some embodiments, as shown in FIGS. 6A-6D, the sear 250 may include a stop pawl 253, a lower cutout 252, a lower pawl 257 and may be axially secured to the firing assembly 104 through the sear pin conduit 251*c*. The sear 250 may have a cutout surface 256 that is operable to provide spacing for the firing pin 145 and valve knocker 144 and provides an increased thickness for the sear spring surface 254. The sear 250 may include a sear spring surface 254 that is under a constant force from the sear spring 260. The lower pawl 257 provides an engagement surface with the wedge post 206 or the second post 204 of the disconnector 200. The position of the lower pawl 257 with respect to the sear pin conduit 251*c* may be substantially constant, and the engagement position of the disconnector 200 to the lower pawl 257 depends on the position of the disconnector. The sear stop pawl 253 may intermittently be in communication with the hammer 130 and provides interference with the hammer teeth 130*a*, 130*b* to prevent the rotation of the hammer 130 and the discharge of a round.

Figure 9A:
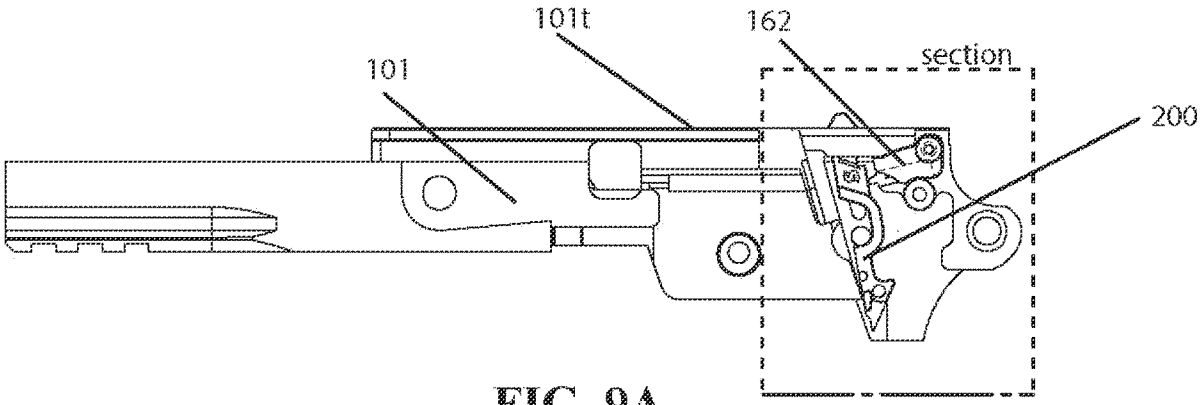
FIG. 9A provides a side view of a frame and disconnector according to an embodiment of the present invention.
Figure 9B:
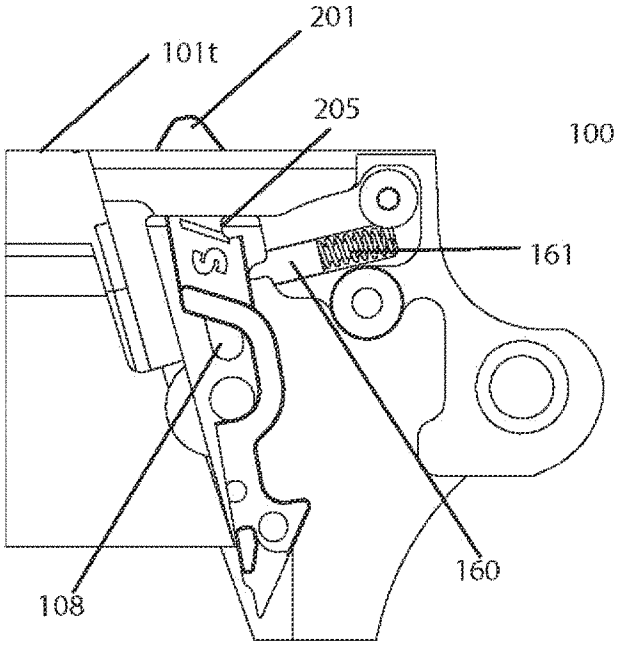
FIG. 9B provides a cropped section of the frame and disconnector in a semi-automatic configuration, according to an embodiment of the present invention.
Figure 9C:
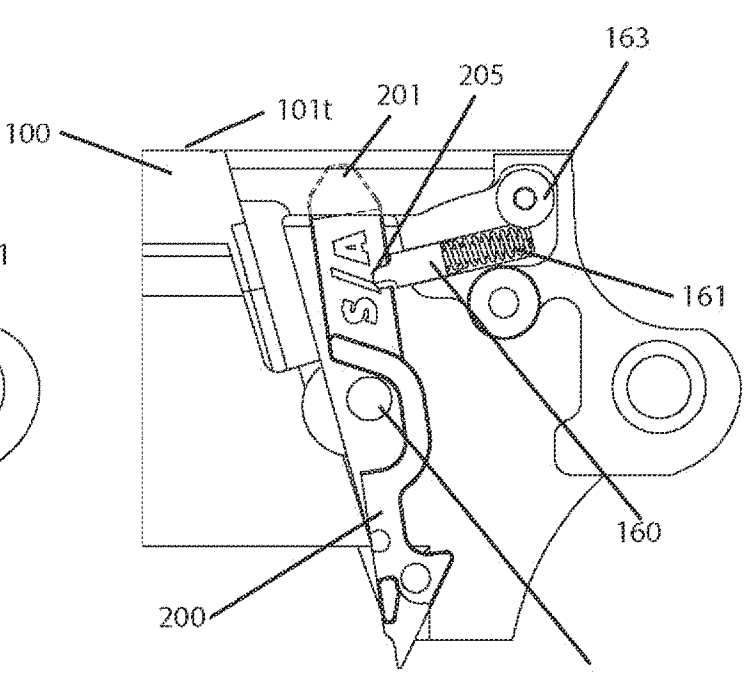
FIG. 9C provides a cropped section of the frame and disconnector in a fully automatic configuration, according to an embodiment of the present invention.

A stripped-down frame 101 illustrated through FIGS. 9A-9C has a top surface 101*t* (e.g., frame rail). The frame 101 may have an interior cavity that secures a selector switch lock 160. The selector switch lock 160 may have a selector switch post 160*a* that extends through the frame and may be spring-loaded with the spring 161, which applies a constant force against the disconnector 200. The selector switch lock 160 and spring 161 are secured to the frame 101 with a switch plate 162. FIG. 9B provides a view of the boxed section of FIG. 9A with the switch plate 162 hidden and the disconnector 200 in a semi-automatic configuration. In such configurations, the disconnector selector post 202 (not shown) is positioned at the top of the slot 108, the sear pin 260 sits near the bottom of the front channel 208, angled tip 201 is positioned above the frame top surface 101*t* and the selector switch lock 160 is adjacent to the disconnector and positioned below the indent 205. In semi-automatic configurations, when the slide 110 is cycled, the blowback unit frame 114 may translate backward, and a disconnector ramp 114*r* translates the disconnector 200 downward, but not down enough to engage the selector switch lock 106. FIG. 9C provides a section view of FIG. 9A with the disconnector 200 in a fully-automatic configuration. In such a configuration, the disconnector selector post 202 (not shown) is positioned at the bottom of slot 108, the switch lock 160 is positioned in the indent 205, the sear pin 260 sits near the top of the front channel 208, and the angled tip 201 is positioned below the frame top surface 101*t*.

Figure 7A:
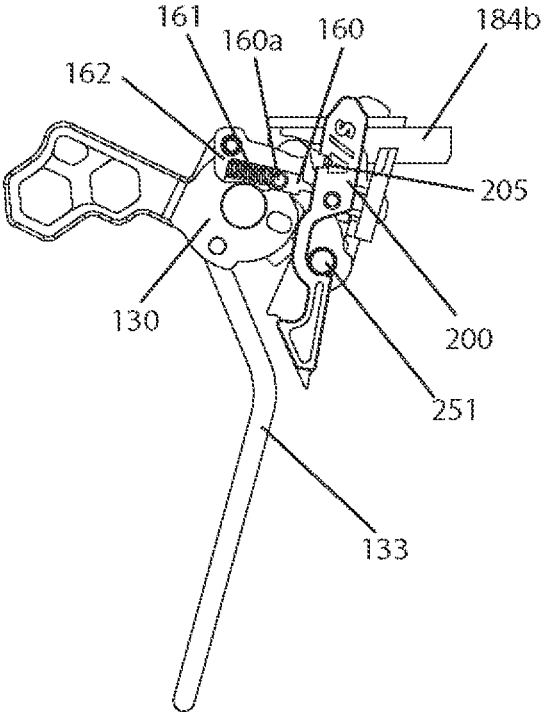
FIG. 7A provides a first side view of a firing assembly in a semi-automatic configuration, according to an embodiment of the present invention.
Figure 8A:
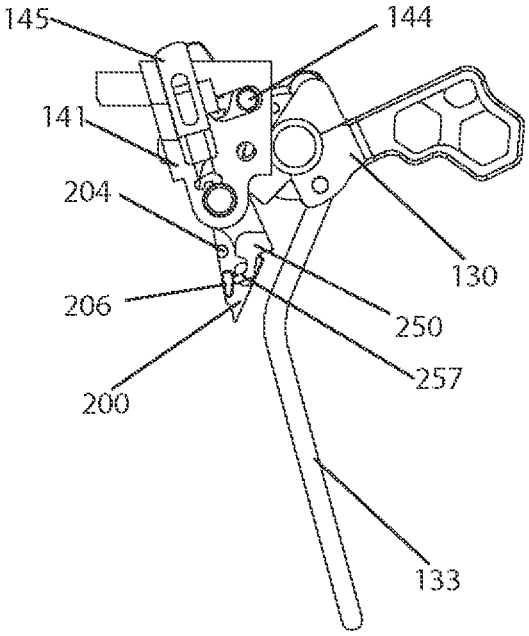
FIG. 8A provides a second side view of a firing assembly in a semi-automatic configuration, according to an embodiment of the present invention.

FIG. 7A shows a first side view of a firing assembly configured in a semi-automatic configuration, and FIG. 8A shows a second side view. In such configurations, the disconnector 200 has a traditional operating position where the angled tip 201 is positioned above the frame 101. As best illustrated in FIG. 8A, when in semi-automatic position, the sear 250 lower pawl 257 is engaged with the disconnector wedge post 206 before the trigger is squeezed. When cycling the round, the sear stop pawl 253 rotates forward and disengages from the hammer teeth 130, allowing for a round to be discharged from the magazine, and the slide 110 translates backward and the disconnector angled tip 201 engages with the blowback unit disconnector ramp 114*r* and slides the disconnector 200 down. When the disconnector 200 is slid down, the lower pawl 257 of the sear 250 disengages from the wedge post 206, the sear 250 rotates clockwise, the lower cutout 252 engages with the disconnector second post 204, and the sear stop pawl 253 rotates to a position that interferes with the hammer teeth 130*a*. In such configurations, while the trigger 106 remains depressed after cycling a round, the lower pawl 253 is positioned between the wedge post 206 and the second post 204, thereby preventing the disconnector 200 from returning to the starting position. When the trigger 106 is released, the sear spring 260 applies pressure to the disconnector sear spring surface 207, translates the disconnector 200 to the starting position, and aligns the lower pawl 257 with wedge post 206.

Figure 7B:
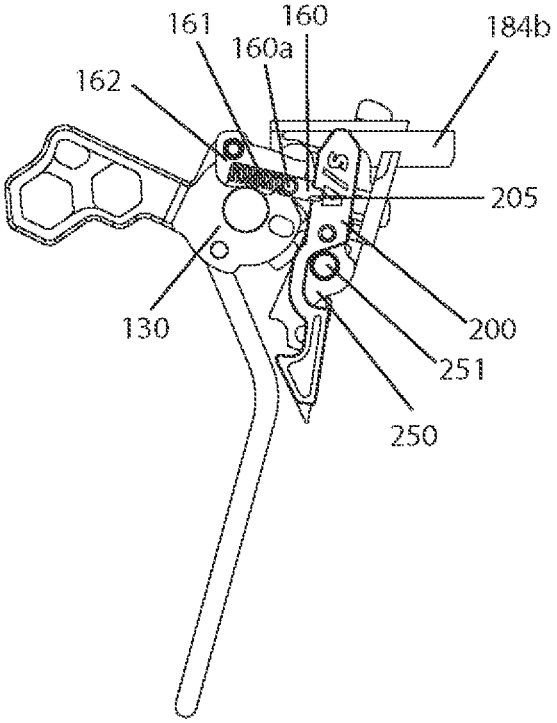
FIG. 7B provides a first side view of a firing assembly in a fully automatic configuration, according to an embodiment of the present invention.
Figure 8B:
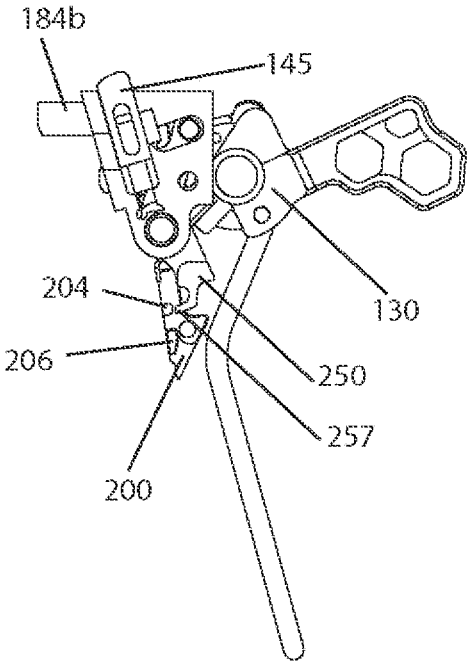
FIG. 8B provides a second side view of a firing assembly in a fully automatic configuration, according to an embodiment of the present invention.

FIG. 7B shows a first side view of a firing assembly configured in a full-automatic configuration, and FIG. 8B shows a second side view. In such configurations, the selector switch pin 160 is engaged with the indent 205 of the disconnector 200, thereby positioning the disconnector angled tip 201 below the frame rail 101*t*. The lower pawl 257 of the sear 250 engages with the second post 204 of the disconnector 200. When the trigger 106 is depressed, the sear 250 rotates counterclockwise around the sear pin 251 and the stop pawl 253 disengages from the hammer teeth 130*a* allowing the hammer to rotate freely. When the trigger 106 is released, the sear 250 rotates clockwise and the stop pawl 253 engages with the hammer teeth 130*a*, thereby interfering with the rotation of the hammer 130 and cycling of a round.

Figure 10:
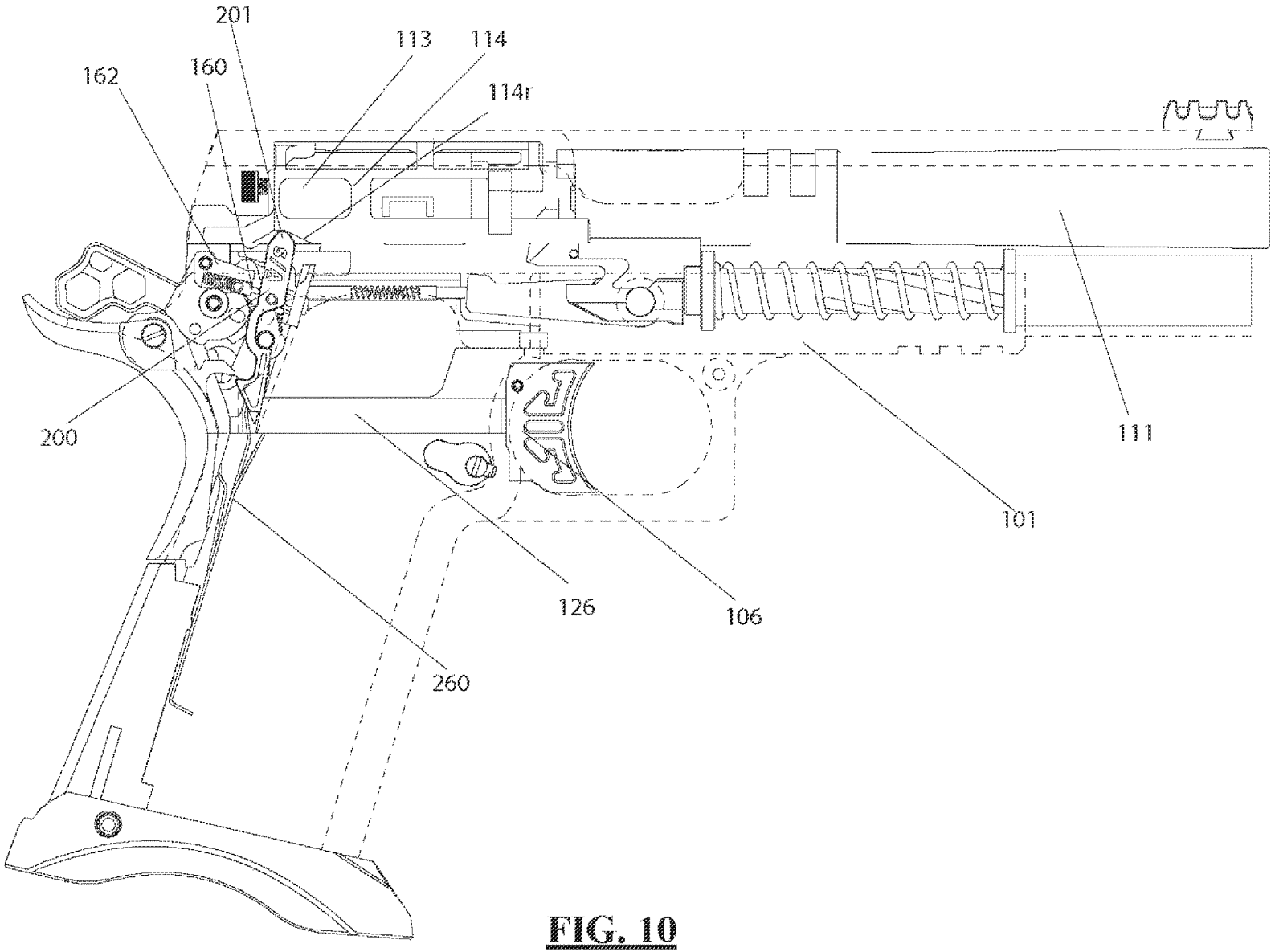
FIG. 10 provides a side view of an airsoft handgun with a transparent frame and slide in a semi-automatic configuration, according to an embodiment of the present invention.
Figure 11:
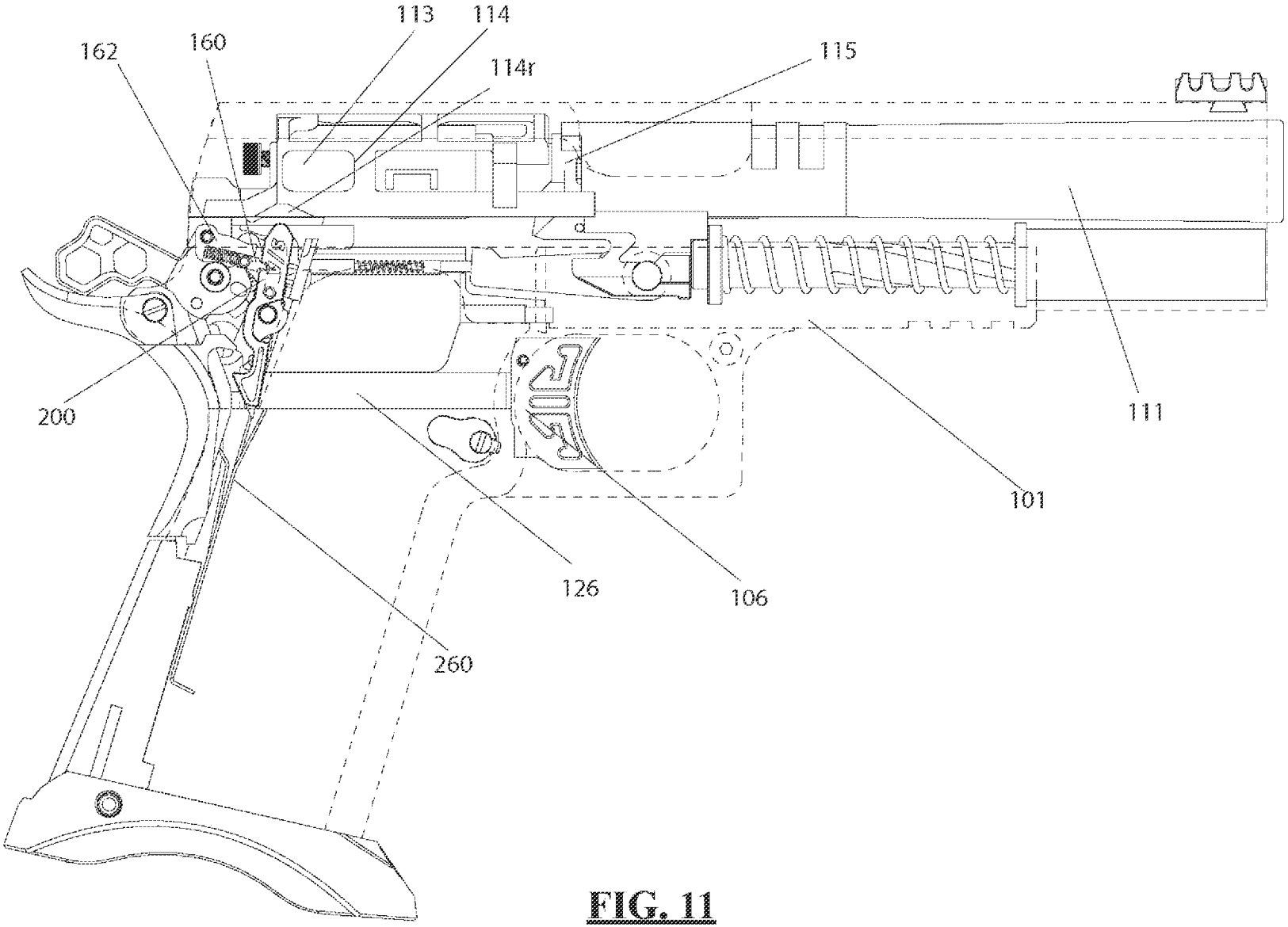
FIG. 11 provides a side view of an airsoft handgun with a transparent frame and slide in a fully automatic configuration, according to an embodiment of the present invention.

FIG. 10 and FIG. 11 provide side views of the airsoft gun 100 with the frame 101 and slide 110 outlined with a wireframe. FIG. 10 provides a semi-automatic configuration of the airsoft gun 100 and FIG. 11 provides a fully automatic configuration of the airsoft gun 100. Transparent frame 101 and slide 110 provide a clear view of the blow back unit 114 and the disconnector ramp 114*r* that engages with the disconnector angled tip 201 in semi-automatic configurations. The trigger 106 is joined to the trigger bar 126 and is operable to translate inputs from the trigger 106 to the disconnector 200 on the trigger bar interface surface 209.

FIGS. 12A-13D provide a cropped section view of a frame 101 with the side panel 184, chassis cover 184*b*, safety 131, grip 105, rear grip 131, firing pin 145, valve knocker 144, knocker spring 142, firing pin spring 146, hammer strut 133, sear spring 260, slide 110, and slide components removed from the assembly to illustrate the various steps and positions of the disconnector 200, sear 250, and hammer 130.

Figure 12A:
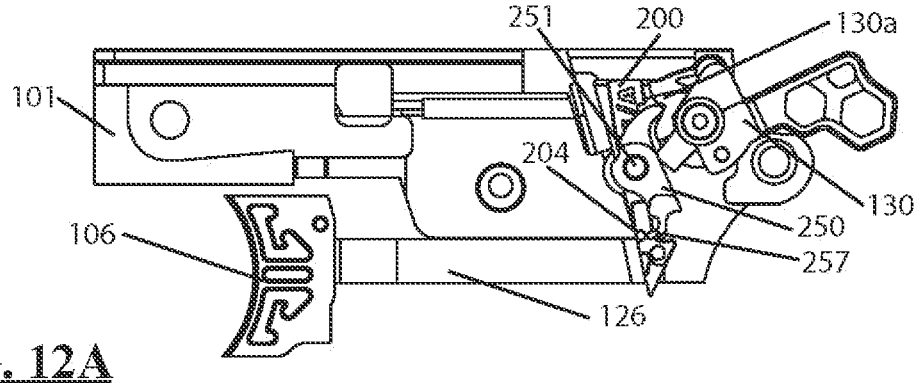
FIG. 12A provides a first stage and a component view of a cropped portion of an airsoft handgun frame in a fully automatic configuration, according to an embodiment of the present invention.
Figure 12B:
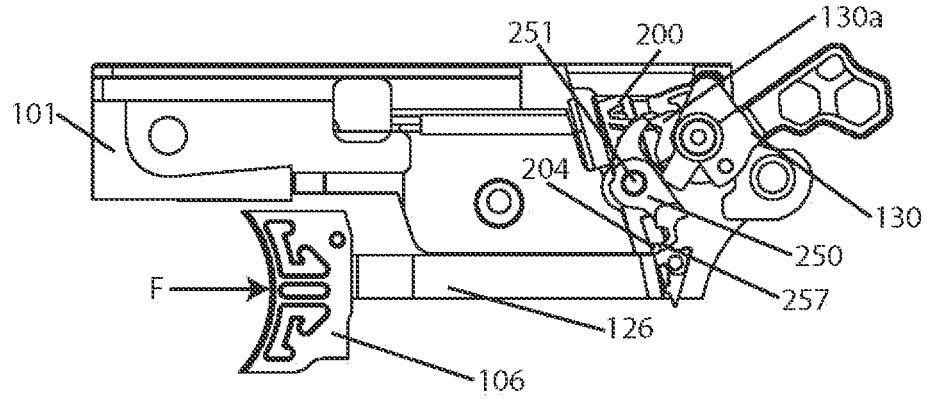
FIG. 12B provides a second stage and a component view of a cropped portion of an airsoft handgun frame in a fully automatic configuration, according to an embodiment of the present invention.
Figure 12C:
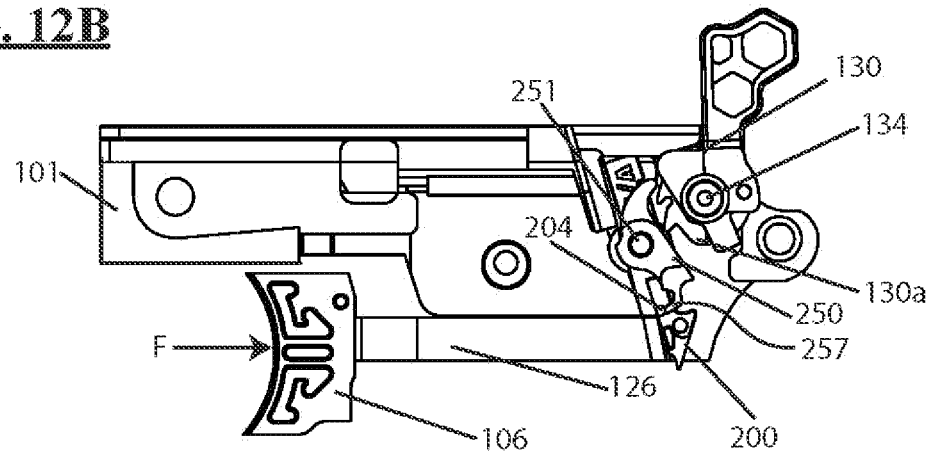
FIG. 12C provides a third stage and a component view of a cropped portion of an airsoft handgun frame in a fully automatic configuration, according to an embodiment of the present invention.
Figure 12D:
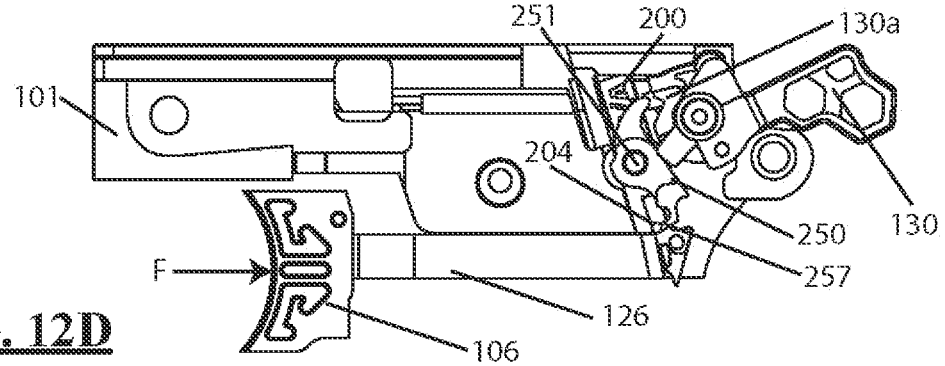
FIG. 12D provides a fourth stage and a component view of a cropped portion of an airsoft handgun frame in a fully automatic configuration, according to an embodiment of the present invention.

In some embodiments, the airsoft handgun 100 may be in a fully automatic configuration, as illustrated in FIGS. 12A-12D. In such embodiments, the disconnector 200 may be positioned in a lower position where the selector pin 202 is configured at the bottom of the frame slot 108, the selector switch pin 260 is engaged with the disconnector indent 105, and the angled tip 201 is below the frame top surface 101*t*, as illustrated in FIGS. 7B, 8B, and 9C. FIG. 12A shows a starting position (e.g., first stage) of the airsoft handgun 101 in a ready position, where the lower pawl 257 of the sear 250 is engaged with the second post 204 of the disconnector. FIG. 12B shows a second stage where a force F is applied to the trigger 106 and is translated through the trigger bar 126 to the disconnector trigger bar interface 209. The disconnector 200 may slide backward with the trigger bar 126, where the disconnector 200 may pivot around the base of frame slot 108 and the sear lock pawl 253 may disengage from the hammer teeth 130*a*. In the third stage, the hammer 130 may be under a spring tension from the hammer strut 133 and hammer strut spring (not shown), forcing a clockwise rotation around the hammer shaft 134 as illustrated in FIG. 12C. In the fourth stage, the slide 110 (not shown) may translate to the rear and reset the hammer 130 to the starting position as shown in FIG. 12D. In some embodiments, the trigger 106 remains depressed, the sear's lower pawl 257 maintains engagement with the disconnector second post 204, and the sears' lock pawl 253 remains in a forward position. Thus, as the slide 110 translates rearward to reset the hammer 130, the locking pawl 257 does not engage with the hammer teeth 130*a*, 130*b* thereby allowing for continuous cycling between the third and fourth stages.

Figure 13A:
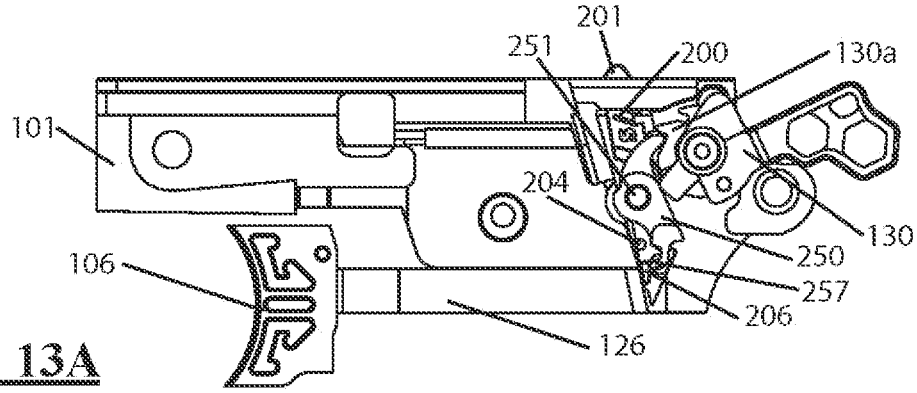
FIG. 13A provides a first stage and a component view of a cropped portion of an airsoft handgun frame in a semi-automatic configuration, according to an embodiment of the present invention.
Figure 13B:
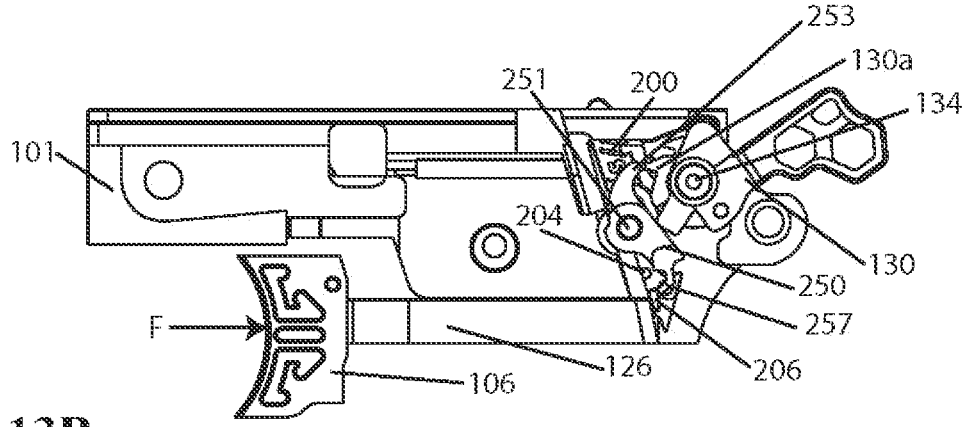
FIG. 13B provides a second stage and a component view of a cropped portion of an airsoft handgun frame in a semi-automatic configuration, according to an embodiment of the present invention.
Figure 13C:
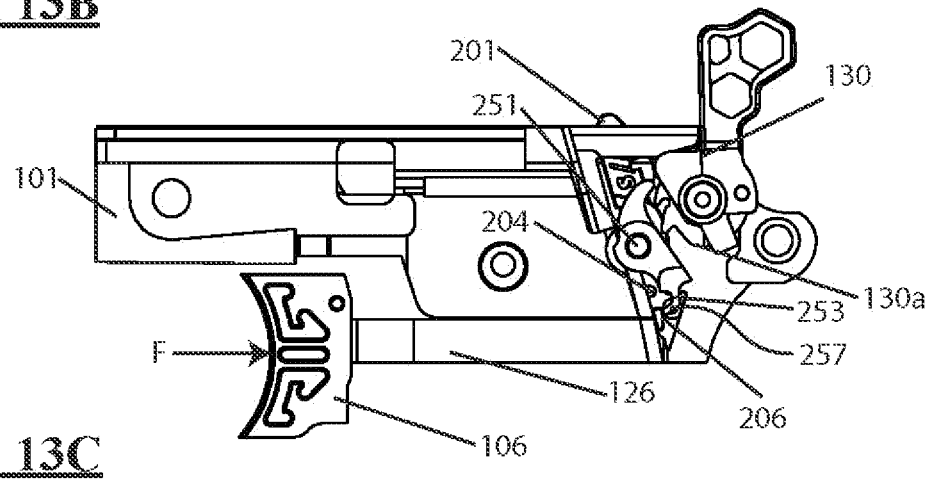
FIG. 13C provides a third stage and a component view of a cropped portion of an airsoft handgun frame in a semi-automatic configuration, according to an embodiment of the present invention.
Figure 13D:
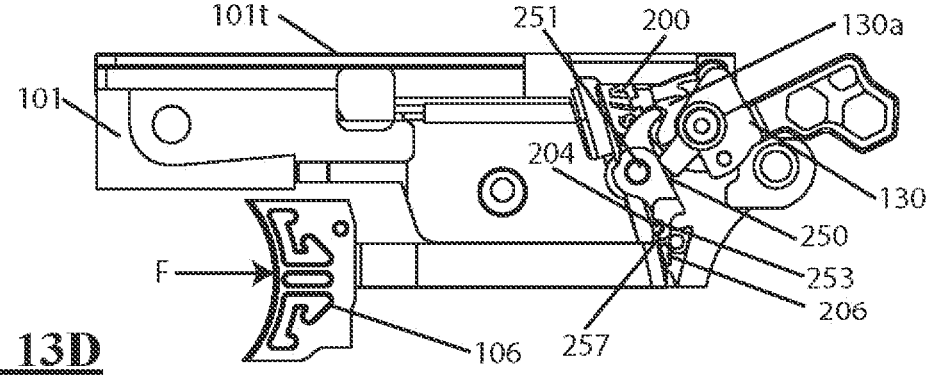
FIG. 13D provides a fourth stage and a component view of a cropped portion of an airsoft handgun frame in a semi-automatic configuration, according to an embodiment of the present invention.

In some embodiments, the airsoft handgun 100 may be in a semi-automatic configuration, as illustrated in FIGS. 13A-13D. In such embodiments, the disconnector 200 may be positioned in an upward position where the selector pin 202 is configured at the top of the frame slot 108, and the slid stop 201 being positioned above the frame top surface 101*t* (e.g., frame rail), as illustrated in FIGS. 7A, 8A, and 9B. In the starting position (e.g., first stage) shown in FIG. 13A the sear locking pawl 253 may be engaged with the hammer teeth 130*a* and the sear lower pawl 257 may be engaged with the wedge post 206 of the disconnector 200. When a force F is applied to the trigger 106, as shown in the second stage of FIG. 13B, the trigger bar 126 may translate backward, thereby rotating the disconnector 200 about the selector pin 202 in the frame slot 108 and the sear 250 may maintain engagement with the wedge post 206 and rotate about the sear pin 251. When the sear 250 rotates, the locking pawl 253 disengages from the hammer teeth 130*a* and releases the hammer 130 to rotate around the hammer shaft 134 to the third stage, as shown in FIG. 13C. A BB may be discharged down the barrel 111, and the slide 110 may translate rearward (not shown) and the angled tip 201 may be engaged with the blowback unit disconnector ramp 114*r* and slide down below the frame top surface 101*t*. When the disconnector 200 slides down, the sear lower pawl 257 loses engagement with the wedge post 206, the sear 250 may rotate clockwise around the sear pin 251, and the lower cutout 252 may engage with the disconnector second post 204 thereby positioning the sear locking pawl 253 to interfere with the hammer teeth 130*a*, as illustrated in the fourth stage of FIG. 13D. While the trigger remains depressed, as shown in FIG. 13D, the airsoft gun 100 is inoperable, and an operator must release the trigger 106, to configure the disconnector and sear in the starting position of FIG. 13A. When the trigger is released, the trigger bar 126 translates forward thereby removing pressure from the trigger bar interface 209, thereby allowing the sear spring 260 to reposition the disconnector and sear to the starting position of FIG. 12A.

In some embodiments, disconnector 200, sear 250, selector pin 160, selector pin spring 161, and selector pin cover plate 162 may be provided as a kit operable to replace the disconnector and sear of a traditional airsoft handgun and provide the ability for a user to configure the airsoft gun platform in a semi-automatic or fully-automatic configuration as described herein.

It is to be understood that variations, modifications, and permutations of embodiments of the present invention, and uses thereof, may be made without departing from the scope of the invention. It is also to be understood that the present invention is not limited by the specific embodiments, descriptions, or illustrations or combinations of either components or steps disclosed herein. The embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed is:

1. A device for selecting a fire rate of an airsoft gun actuating system, the device comprising: a. a sear having a stop pawl on a top end, a lower cutout, and a lower engagement surface at the base of said lower cutout; b. a disconnector having body, an angled tip on a top end, a selector post on a first side, an engagement post and a wedge post on a second side, a trigger bar interface on a front surface, and a locking indent on a rear surface; and c. a frame having a channel operable to receive said disconnector body and a slot operable to receive said selector post and being operable to secure a trigger, a slide, a hammer and rotatably secure said sear; wherein said disconnector is operable to configure the sear in a semi-automatic and fully automatic firing position.

2. The device of claim 1, wherein said disconnector is in communication with said trigger on said trigger bar interface and is operable to translate with said trigger and rotate around said selector post when said trigger is engaged.

3. The device of claim 1, wherein said sear lower pawl is engaged with said disconnector wedge post in semi-automatic configurations and is operable to disengage said locking pawl from a hammer tooth of said hammer when said trigger is engaged.

4. The device of claim 3, wherein said trigger is engaged and a round is discharged and a slide translates to the rear and a disconnector angled tip engages with a blowback unit disconnector ramp and translates downward, thereby disengaging said sear lower pawl from said disconnector wedge post and said sear lower cutout engages with said disconnector engagement post.

5. The device of claim 1, wherein said lower cutout engages with said disconnector engagement post, thereby positioning said sear locking pawl with said hammer teeth, and locking said hammer.

6. The device of claim 1, wherein said frame is operable to secure a selector switch assembly, comprising:

a. a selector pin positioned between said frame and disconnector that is operable to engage with said disconnector locking indent and lock said disconnector below said frame;

b. a spring between a selector pin and a frame slot that is operable to translate said selector pin forward; and c. a cover that is operable to hide and secure said selector pin and spring to said frame.

7. The device of claim 6, wherein said disconnector selector post is positioned at a bottom of said frame slot and said selector pin is positioned in said disconnector locking indent to configure said disconnector in a fully automatic firing configuration.

8. The device of claim 7, wherein said fully automatic firing configuration positions said disconnector angled tip below a top of said frame and said lower pawl of said sear in engagement with said engagement post.

9. The device of claim 8, wherein said disconnector is in communication with said trigger on said trigger bar interface and is operable to translate with said trigger and rotate around said selector post when said trigger is engaged and said sear is operable to rotate around a sear pin to disengage said locking pawl from said hammer teeth when said trigger is depressed and a round is discharged.

10. The device of claim 9, wherein said sear is engaged with said disconnector engagement post while said trigger remains depressed and said locking pawl maintains disengagement from said hammer teeth, thereby allowing for continuous rotation of said hammer and discharging of a round.

11. A semi-automatic and fully automatic firing switch device for an airsoft gun actuating system, the device comprising: a. a frame being operable to secure a trigger mechanism, a slide, a barrel, a safety switch, and providing a slot for controlling said trigger mechanism with a selector switch; and b. said trigger mechanism comprising: i. a trigger and a trigger bar in communication with a disconnector having a selector post that extends through said frame slot and is operable to configure said disconnector in a locked automatic position and a semi-automatic position; and ii. a sear in communication with said disconnector and under a spring tension that is operable to actuate a hammer and regulate a rate of fire; wherein said trigger mechanism disconnector is in communication with said selector switch and is operable to position said disconnector above a frame rail for semi-automatic fire and below said frame rail for fully automatic fire.

12. The device of claim 11, wherein said trigger mechanism is in a semi-automatic position and said sear includes a lower pawl that engages with a disconnector wedge post.

13. The device of claim 12, wherein said trigger is engaged and said disconnector translates with said trigger bar and said sear lower pawl maintains engagement with said disconnector wedge post and a sear locking pawl disengages from said hammer and a round is propelled through said barrel and said slide translates backward.

14. The device of claim 13, wherein said slide translates backward, resetting said hammer and translates said disconnector down, thereby disengaging said sear lower pawl from said disconnector wedge post and positioning a lower cutout of said sear in collision with a disconnector engagement post, thereby rotating said sear and locking pawl in a position to lock said hammer.

15. The device of claim 14, wherein said position to lock said hammer is maintained while said trigger is engaged and said sear and disconnector are in communication with a sear spring that is operable to position said sear and disconnector to a starting position when said trigger is released.

16. The device of claim 11, wherein said trigger assembly is configured in a fully automatic position and a user slides said selector post to the bottom of said frame slot, thereby dropping said disconnector to a lower position and positioning a sear lower pawl in contact with a disconnector engagement post.

17. The device of claim 16, wherein said trigger is engaged and said disconnector and sear are translated and a sear locking pawl disengages from said trigger allowing a round to propel down said barrel and said slide translates backward, thereby resetting said hammer and said locking pawl and disconnector maintain the translated position allowing for continuous actuation of said hammer and slide while said trigger is engaged.

18. The device of claim 17, wherein said trigger is disengaged and said disconnector and sear translate to the starting position and said sear locking pawl is engaged with said hammer, thereby interfering with said hammer rotation.

19. A device for selectively switching an airsoft gun actuating mechanism between a semi-automatic and a fully automatic configuration, comprising: a. a frame provided with a disconnector, a sear, a trigger, a hammer, a selector switch, and a slide housing a barrel and a blowback unit; and b. a spring-loaded selector lock positioned in said frame that is operable to lock said disconnector below said frame; wherein said disconnector is in constant engagement with said sear and is under a spring tension such that when the trigger is squeezed the disconnector swivels about a frame mounting point and the engagement of the sear with said hammer is severed thereby rotating said hammer and discharging a round through said barrel and said slide translates backward to reset said hammer.

20. The device of claim 19, wherein said disconnector includes a selector pin that is positioned in a frame slot and is operable to be configured by a user such that said fully automatic configuration positions said disconnector below a frame rail and said selector pin at a base of said frame slot and said semi-automatic position configures said disconnector and selector pin at a top of said frame slot.

* * * * *